US005467366A

United States Patent [19]

Wilhelmi et al.

[11] Patent Number: 5,467,366

[45] Date of Patent: Nov. 14, 1995

[54] ELECTRODE SYSTEM

[75] Inventors: Herbert Wilhelmi, Aachen; Eberhard Steinmetz, Essen; Klaus Peters, Aachen, all of Germany

[73] Assignee: Messer Griesheim GmbH, Germany

[21] Appl. No.: 324,801

[22] Filed: Oct. 18, 1994

[30] Foreign Application Priority Data

Oct. 27, 1993 [DE] Germany ..... 43 36 628.7

[51] Int. Cl.[6] ..... F27D 23/04

[52] U.S. Cl. ..... 373/85; 373/82; 373/116; 373/105

[58] Field of Search ..... 373/79, 81, 82, 373/85, 106, 116, 120–124, 126, 102, 104, 105, 108, 47, 49–50

[56] References Cited

U.S. PATENT DOCUMENTS 3,147,331 9/1964 Brugger ..... 373/82

3,585,269 6/1971 Krause ..... 373/82

4,039,738 8/1977 Beskin et al. ..... 373/82

*Primary Examiner*—Tu Hoang

*Attorney, Agent, or Firm*—Connolly and Hutz

[57] ABSTRACT

The invention relates to an electrode system for melting and stirring and also for temperature control in metallurgical vessels. To achieve optimum energy utilization with minimal gas consumption, the electrode system comprises, according to the invention, a central electrode and an outer electrode (10, 11) which are each attached to a height adjustment (12) and are connected to a common electric power source (16), to form an electric arc between central electrode and melt below the surface of the melt bath, and an annular space (23) between central electrode and outer electrode (10, 11), which is connected to a gas source (25), with the gas system being designed in such a way that finely particulate additives can also be charged into the melt.

9 Claims, 1 Drawing Sheet

ELECTRODE SYSTEM

BACKGROUND OF THE INVENTION

1. Field of the Invention

The invention relates to an electrode system for melting and stirring and for temperature control in metallurgical vessels. The heat source is an electric arc between central electrode and melt. This can, in particular, also be operated under the surface of the bath. As a result of the immersed operating state, the flushing and heating can be achieved in a single step using one gas feed.

2. Description of the Prior Art

For electrode systems for immersion burners, as for other heating systems in metallurgy, a high efficiency of energy utilization is required, because the melting and further heating of the lumpy material requires high melting power. To homogenize the melt in respect of temperature and composition, the melt also has to be stirred. In addition, in a continuous mode of operation, the charging of particulate raw materials and additives into the melt has to be made possible. Furthermore, the melting and heating process should be flexible in respect of the raw materials and additives and also result in low emissions and small amounts of waste.

SUMMARY OF THE INVENTION

It is therefore an object of the invention to provide an electrode system for melting and stirring and also for temperature control in metallurgical vessels, by means of which optimum energy utilization can be achieved with minimal gas consumption and which also makes possible environmentally appropriate processing of hazardous, dust-like residue materials.

In the electrode system of the invention, the immersed operation of the electric arc between central electrode and melt (metal or slag) in combination with suitable metering in of gas achieves a very high efficiency of energy utilization, because the dissipation of the electric arc onto the furnace lining (walls and lid) no longer occurs. The hot arc gases heat the feedstock and are cooled significantly while rising through the melt. The furnace atmosphere is therefore not too hot, so that the metallurgical vessels above the surface of the melt bath do not have to be provided with cooling. In one embodiment of the electrodes made of graphite, the entire immersion lance facility can be operated safely and reliably without additional cooling. In the case of aluminum or copper melts, the graphite electrode materials do not react with the metal bath. In the case of steel melts, the outer electrode can be provided with a coating of refractory material to reduce the undesired carbon enrichment of the steel melt. If the melt should not come into contact with graphite, the end of the outer electrode which dips into the melt can be coated externally and internally with ceramic and the electrical circuit is closed via central electrode—melt—bottom electrode.

In immersed operation, a minimal gas consumption is required for melting and further heating of the raw materials, which, owing to the omission of the separate flushing gas and reduced homogenization times, is achieved by suitable positioning of the electrodes. The gas requirement of Ar or $N_2$ or reducing gas is only 50% of that of blowing systems. Via the annular space between the central and outer electrodes, particulate materials, in particular dusts, can also be introduced together with the blown-in gas directly into the interior of the melt, which avoids uncontrolled material losses, for example into the slag or the waste gas system. The further charging is carried out in the hotest part of the melt, so that the solid materials can be melted and dissolved more quickly. At the same time it is ensured, in the addition of mixtures, that components having a low boiling point, for example Pb and Zn, are largely evaporated.

The invention also makes possible environmentally appropriate processing of hazardous, lumpy to dust-like residue materials, such as filter dusts from steel production and refuse incineration or aluminum sweepings or residue materials from grinding operations, because the electrode space has a closed configuration, the residue materials are introduced not onto but into the melt and the hot metal bath makes the inorganic and organic pollutants nonhazardous.

An example of the invention is shown in the diagram and is described in more detail below.

DESCRIPTION OF THE PREFERRED EMBODIMENTS

Figure 1:
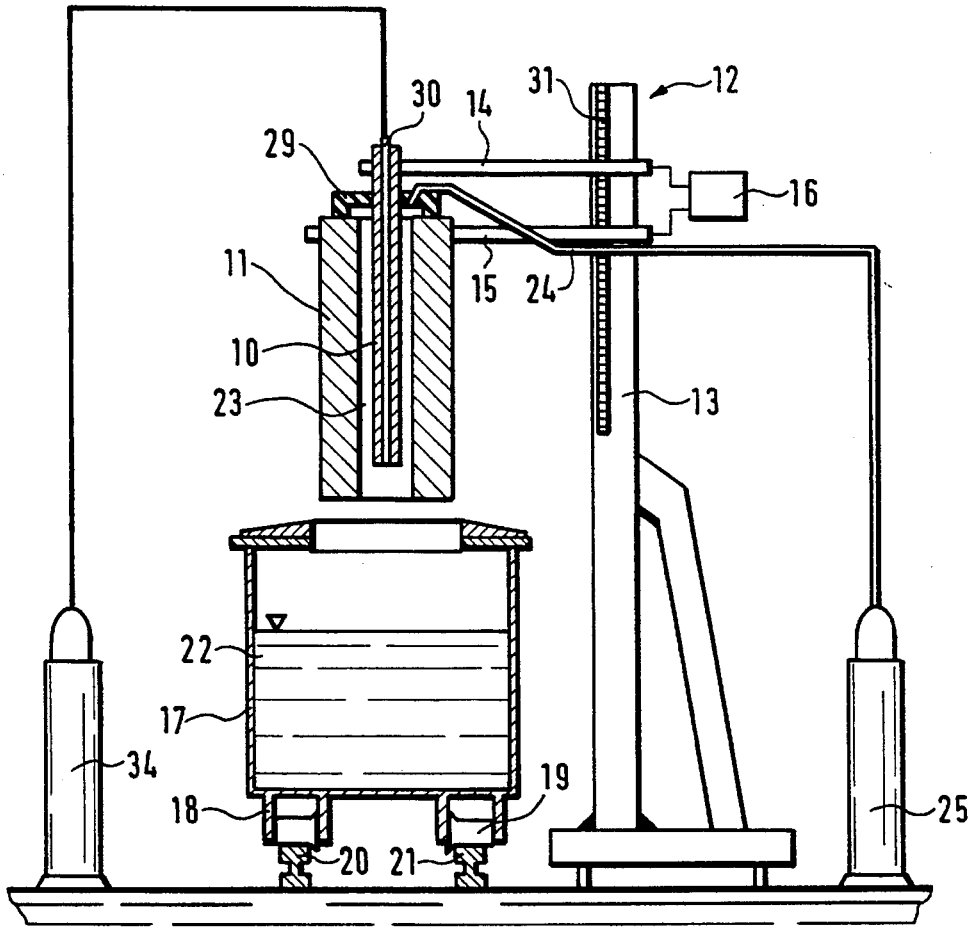
FIG. 1 shows the electrode system of the invention in an immersion lance facility on standby.
Figure 2:
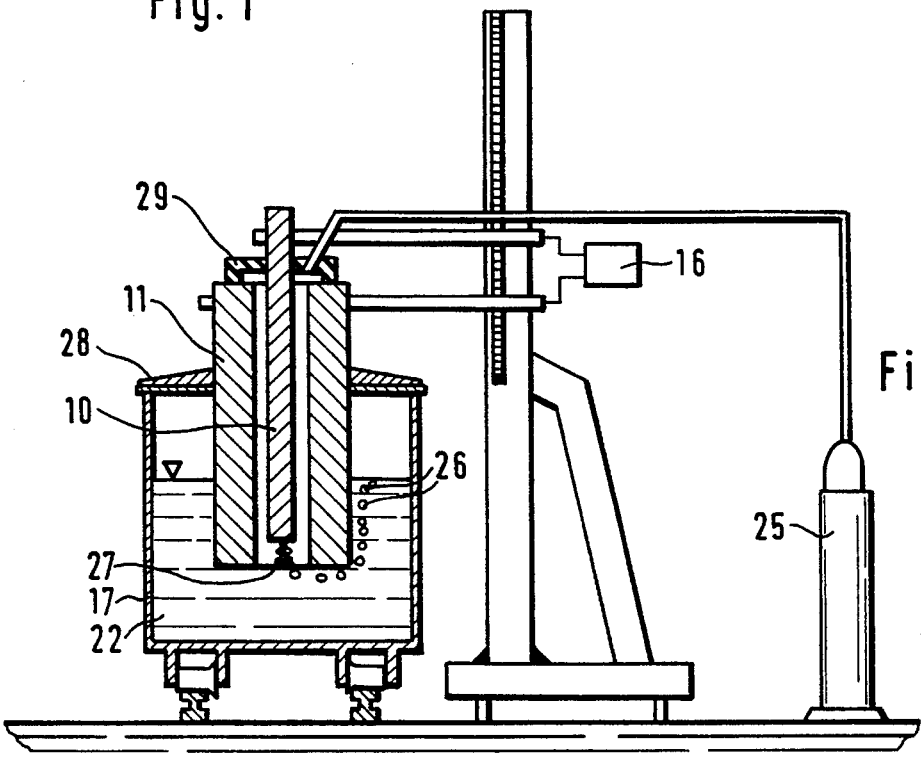
FIG. 2 shows the electrode system during immersed operation.

The electrode system shown in FIGS. 1 and 2 comprises a central electrode 10 and an outer electrode 11, which are each hung on a support column 13. By means of the height adjustment 12, the electrode bearer arms 14, 15 can move together and individually and can thus be positioned independently of one another. The two electrodes 10, 11 are connected to an electric power source 16, with the supply of electricity being carried out, as a matter of choice, via cable or conductor-rail connections or via electrically conductive electrode bearer arms.

For controlled operation of the furnance, the support column 13 and the bearer arms 14, 15 are provided with a sensor system 31 which detects the respective electrode position. The sensor system comprises a toothed rack which is mounted on the support column and a pinion potentiometer system on each bearer arm. The linear movement of the bearer arms is converted by the rackpinion potentiometer system into an electrical potential, with the potential changing in proportion to the distance travelled. In addition, absolute positions are detected so that a one-off calibration, for example on assembly, is sufficient for position determination.

Below the electrode system there is arranged a metallurgical vessel 17. The metallurgical vessel 17 can be equipped with transport rollers 18, 19 by means of which it can be moved on rails 20, 21. In addition, it is possible for the support column 13 to be designed as a kingpin so that the components 10, 11, 12, 13, 14, 15, 23, 24, 29, 30 and 31 can be swivelled about the axis 1. For melting lumpy material, the system can be operated using the central electrode 10 alone, if a bottom electrode connected to the electricity supply is installed in the metallurgical vessel. If a bottom electrode is not provided, the electrode system is lowered into the metallurgical vessel 17 so that during the homogenization phase the electrically conducting central electrode 10 and the outer electrode 11 dip below the surface of the melt 22 (FIG. 2). Gas, for example argon (Ar), nitrogen ($N_2$) or, if desired, also reducing gases, flow through the annular space 23 formed between central electrode 10 and outer electrode 11. The gas flows from the side away from the melt 22 via the line 24 connected to a gas source 25 into the annular space 23 and from there into the electric arc burning between central electrode 10 and the surface of the melt bath, which arc thus heats the gases. The hot gas 26 escapes under the outer electrode 11 through the melt 22, transfers energy to the latter and sets it into motion for homogenization. Particulate materials, in particular dusts, can also be introduced together with the blown-in gas directly into the interior of the melt 22, which avoids material losses, for example into the slag or the waste gas system.

Environmentally appropriate processing of hazardous, dust-like residue materials is also achieved by a closed system being provided by means of a lid 28 closing the metallurgical vessel 17. The lid 28 is here in apposition with the outer region of the outer electrode 11. As a result of the very low gas consumptions, the amount of waste gas formed is small. Furthermore, to avoid gas losses, a seal 29 is provided, above the gas inlet, to close off the annular space 23 between the central electrode 10 and the outer electrode 11. The seal 29 seals off the annular space 23 from the atmosphere. The closed system can, for disposal of hazardous, dust-like or gaseous residue materials, be connected to a disposal system not shown in more detail.

In addition, it is possible in principle to design the central electrode 10 likewise in the form of a pipe, so that a further gas channel 30 can be utilized. This is particularly advantageous if gas mixtures are used, but the amount of one type of gas is, for cost reasons, to be kept as small as possible and nevertheless the desired gas atmosphere is to be set in the region of the arc. That is the case, for example, in the reduction melting of finely particulate materials. The material is supplied together with nitrogen via the annular gap 23 between the central electrode and the outer electrode and the reducing gas, for example hydrogen ($H_2$) or methane ($CH_4$), is fed in through the drilled hole 30 of the central electrode 10.

We claim:

1. An electrode system for melting and stirring and also for temperature control in metallurgical vessels, comprising a central electrode and an outer electrode which are each attached to a height adjustment and are connected to a common electric power source, and an annular space formed between central electrode and outer electrode which is connected to a gas source.

2. An electrode system as claimed in claim 1, wherein the gas source has an inlet leading to the annular space between the central electrode and outer electrode, and the annular space is sealed off from the atmosphere by means of a seal above the gas inlet.

3. An electrode system as claimed in claim 2, including a metallurgical vessel below the outer electrode, and a lid closing the vessel.

4. An electrode system as claimed in claim 3, wherein the central and outer electrodes are movable to different positions by the height adjustment, and the height adjustment has a sensor system detecting the respective electrode positions.

5. An electrode system as claimed in claim 4, wherein the central electrode has a gas channel which is connected to a gas source.

6. An electrode system as claimed in claim 3, wherein the central electrode has a gas channel which is connected to a gas source.

7. An electrode system as claimed in claim 2, wherein the central electrode has a gas channel which is connected to a gas source.

8. An electrode system as claimed in claim 1, wherein the central electrode has a gas channel which is connected to a gas source.

9. An electrode system as claimed in claim 1, further comprising a vessel which is closed by means of a lid extending to an outer region of the outer electrode.

* * * * *